United States Patent [19]

Kukes

[11] Patent Number: 4,529,503

[45] Date of Patent: Jul. 16, 1985

[54] DEMETALLIZATION OF HYDROCARBON CONTAINING FEED STREAMS WITH PHOSPHOROUS COMPOUNDS

[75] Inventor: Semyon G. Kukes, Bartlesville, Okla.

[73] Assignee: Phillips Petroleum Company, Bartlesville, Okla.

[21] Appl. No.: 405,645

[22] Filed: Aug. 5, 1982

[51] Int. Cl.[3] ..... C10G 25/00; C10G 29/02

[52] U.S. Cl. ..... 208/251 R; 208/251 H

[58] Field of Search ..... 208/251 H, 251 R, 52 CT

[56] References Cited

U.S. PATENT DOCUMENTS 4,321,128 3/1982 Yoo ..... 208/52 CT

*Primary Examiner*—D. E. Gantz

*Assistant Examiner*—Anthony McFarlane

[57] ABSTRACT

Metals contained in a hydrocarbon containing feed stream are removed by contacting the hydrocarbon containing feed stream with a phosphorous compound selected from the group consisting of phosphine, hydrocarbylphosphines, hydrocarbylphosphites, hydrocarbylphosphonates, hydrocarbylphosphates, hydrocarbylphosphine oxides, hydrocarbylthiophosphites, and hydrocarbylphosphine sulfides to convert the metals to oil insoluble compounds which can be removed from the hydrocarbon containing feed stream by conventional methods.

10 Claims, 4 Drawing Figures

● 4% $(PhO)_2$ P(O)H

▲ .3% $(PhO)_2$ P(O)H

⊠ 0% $(PhO)_2$ P(O)H

DEMETALLIZATION OF HYDROCARBON CONTAINING FEED STREAMS WITH PHOSPHOROUS COMPOUNDS

This invention relates to a process for removing metals from a hydrocarbon containing feed stream.

It is well known that crude oil as well as products from extraction and/or liquifaction of coal and lignite, products from tar sands, products from shale oil and similar products may contain metals such as vanadium and nickel. When these hydrocarbon containing feeds are fractionated, the metals tend to concentrate in the heavier fractions such as the topped crude and residuum. The presence of the metals make further processing of these heavier fractions difficult since the metals generally act as poisons for catalysts employed in processes such as catalytic cracking, hydrogenation or hydrodesulfurization.

It is thus an object of this invention to provide a process for removing metals from a hydrocarbon containing feed stream so as to improve the processability of such hydrocarbon containing feed stream and especially improve the processability of heavier fractions such as topped crude and residuum.

In accordance with the present invention, a phosphorus compound selected from the group consisting of phosphine, hydrocarbylphosphines, hydrocarbylphosphites, hydrocarbylphosphates, hydrocarbylphosphonates, hydrocarbylphosphine oxides, hydrocarbylthiophosphites, and hydrocarbylphosphine sulfides is mixed with a hydrocarbon containing feed stream, which also contains metals, under suitable demetallization conditions. It is believed that the phosphorus compounds react with metals contained in the hydrocarbon containing feed stream to form oil insolubles compounds that can be removed from the hydrocarbon containing feed stream by any conventional method such as filtration, centrifugation or decantation. Removal of the metals from the hydrocarbon containing feed stream in this manner provides for improved processability of the hydrocarbon containing feed stream in processes such as catalytic cracking, hydrogenation and hydrodesulfurization.

Other objects and advantages of the invention will be apparent from the foregoing brief description of the invention and the appended claims as well as the detailed description of the invention which follows.

FIGS. 1–4 are briefly described as follows:

FIG. 1 is an illustration of the effect of temperature on the removal of metals;

FIG. 2 is an illustration of the effect of residence time on the removal of metals;

FIG. 3 is an illustration of the effect of the concentration of diphenylphosphite in the hydrocarbon containing feed stream on the removal of metals; and FIG. 4 is an illustration of the effect of hydrogen flow rate on the removal of metals.

Figure 1:
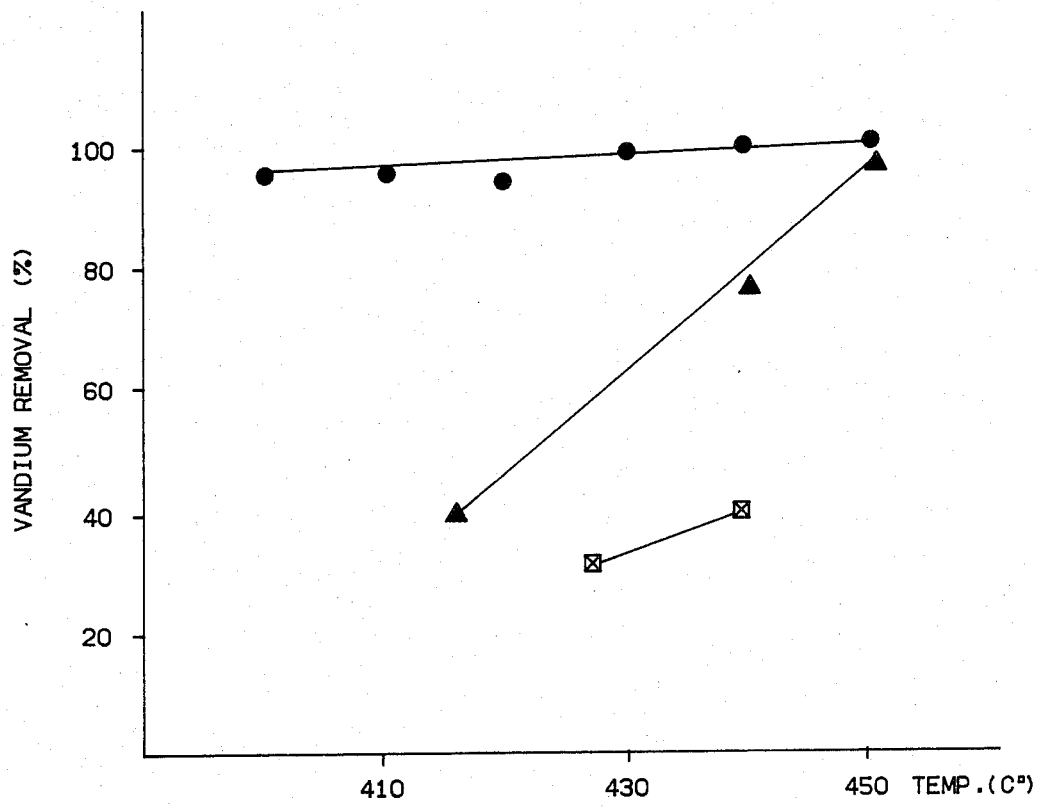
FIGS. 1–4 are utilized to present data from the Examples.

Any metal which will react with the phosphorus compounds of the present invention to form an oil insoluble compound can be removed from a hydrocarbon feed stream in accordance with the present invention. The present invention is particularly applicable to the removal of vanadium and nickel.

Metals may be removed from any suitable hydrocarbon containing feed streams. Suitable hydrocarbon containing feed streams include petroleum products, coal pyrolyzates, products from extraction and/or liquifaction of coal and lignite, products from tar sands, products from shale oil and similar products. Suitable hydrocarbon feed streams include gas oil having a boiling range from about 205° C. to about 538° C., topped crude having a boiling range in excess of about 343° C. and residuam. However, the present invention is particularly directed to heavy feed streams such as heavy topped crudes and residuam and other materials which are generally regarded as being too heavy to be distilled. These materials will generally contain the highest concentrations of metals such as vanadium and nickel.

As has been previously stated, the organic phosphorus compounds employed in the present invention are selected from the group consisting of phosphine, hydrocarbylphosphines, hydrocarbylphosphites, hydrocarbylphosphonates hydrocarbylphosphates, hydrocarbylphosphine oxides, hydrocarbylthiophosphites, and hydrocarbylphosphine sulfides.

Phosphine is characterized by formula 1

$$PH_3 \tag{1}$$

Any suitable hydrocarbylphosphines can be used in the practice of the invention. Suitable hydrocarbylphosphines are generally characterized by formula 2

$$R_xPH_{3-x} \tag{2}$$

wherein x is 1, 2 or 3. Suitable hydrocarbylphosphines include ethylphosphine, dipropylphosphine, tri-n-butylphosphine, tri-phenylphosphine and n-hexyl-diphenylphosphine.

Any suitable hydrocarbylphosphites can be used in the practice of the invention. Suitable hydrocarbylphosphites are generally characterized by formulas 3 and 4:

$$(RO)_xP(O)H(OH)_{2-x} \tag{3}$$

$$(RO)_3P \tag{4}$$

where x is 1 or 2. Suitable hydrocarbylphosphites include dimethyl phosphite, diethyl phosphite, diphenyl phosphite, trimethyl phosphite, triethyl phosphite and triphenyl phosphite.

Any suitable hydrocarbylphosphonate can be used in the practice of this invention. Suitable hydrocarbylphosphonates are generally characterized by formula 5:

$$(RO)_xP(O)R(OH)_{2-x} \tag{5}$$

where x is 1 or 2. Suitable hydrocarbylphosphonates include dimethyl-ethylphosphonate, dimethyl-butylphosphonate, and dimethyl-phenylphosphonate.

Any suitable hydrocarbylphosphates can be used in the practice of the invention. Suitable hydrocarbylphosphates are generally characterized by formula 6:

$$(RO)_xPO(OH)_{3-x} \tag{6}$$

where x is 1, 2 or 3. Suitable hydrocarbylphosphates include methyl phosphate, ethyl phosphate, dimethyl phosphate, diethyl phosphate, trimethyl phosphate, triethyl phosphate and triphenyl phosphate. Preferred are compounds with $x=3$.

Any suitable hydrocarbylphosphine oxides can be used in the practice of the invention. Suitable hydrocarbylphosphine oxides are generally characterized by formula 7

$$R_xP(O)H_{3-x} \quad (7)$$

where x is 1, 2 or 3. Suitable hydrocarbylphosphine oxides include dimethyl phosphine oxide, diethyl phosphine oxide, diphenyl phosphine oxide, trimethyl phosphine oxide, triethyl phosphine oxide and triphenyl phosphine oxide.

Any suitable hydrocarbylthiophosphites can be used in the practice of the invention. Suitable hydrocarbylthiophosphites are generally characterized by formulas 8–12:

$$(RO)_2P(S)H \quad (8)$$

$$(RO)(RS)P(O)H \quad (9)$$

$$(RO)(RS)P(S)H \quad (10)$$

$$(RS)_2P(O)H \quad (11)$$

$$(RS)_2P(S)H. \quad (12)$$

where x is 1, 2 or 3. Suitable dihydrocarbylthiophosphites include dimethyl thiophosphite, diethyl thiophosphite, diphenyl thiophosphite, trimethyl thiophosphate, triethyl thiophosphate and triphenyl thiophosphate.

Any suitable hydrocarbylphosphine sulfides can be used in the practice of the invention. Suitable hydrocarbylphosphine sulfides are generally characterized by formula 13.

$$R_xP(S)H_{3-x} \quad (13)$$

where x is 1, 2 or 3. Suitable hydrocarbylphosphine sulfides include trimethyl phosphine sulfide, triethyl phosphine sulfide, triphenyl phosphine sulfide, dimethyl phosphine sulfide, diethyl phosphine sulfide and diphenyl phosphine sulfide.

For formulas 1–13, R can be alkyl or aryl and can contain from 1 to 12 carbon atoms. Preferably the hydrocarbyl substituents will contain 6 or less carbon atoms with the methyl group being most preferred because the methyl group shields the phosphorus atom least and methyl compounds are generally least expensive.

The process of this invention can be carried out by means of any apparatus whereby there is achieved a mixing of the phosphorus compound with the hydrocarbon containing feed stream. The process is in no way limited to the use of a particular apparatus. The process can also be carried out as a continuous process or as a batch process. The term hydrocarbon containing feed stream is used herein to refer to both a continuous and batch process although the hydrocarbon containing fluid will generally not be flowing in a batch process.

Any suitable amount of the phosphorus compound can be added to the hydrocarbon containing feed stream. Preferably, the amount of the phosphorus compound added to the hydrocarbon containing feed stream will result in a concentration of the phosphorus compound in the range of about 0.01 to about 50 weight percent based on the weight of the hydrocarbon containing feed stream. More preferably, the concentration of the phosphorus compound will be in the range of about 0.05 to about 5 weight percent based on the weight of the hydrocarbon containing feed stream.

If an excess of the phosphorus compound is used in the demetallization process, the excess phosphorus compound can be removed from the treated oil by distillation in instances where the volatility of the phosphorus compound utilized is suitable. If the volatility is not suitable, the excess phosphorus compound can be thermally decomposed which will generally result in its conversion to an insoluble form which can be removed from the hydrocarbon containing feed stock when the metals are removed.

Any suitable reaction time between the phosphorus compound and the hydrocarbon containing feed stream may be utilized. In general, the reaction time will range from about 0.01 hours to about 100 hours. Preferably, the reaction time will range from about 0.1 to about 2 hours. Thus, for a continuous process, the flow rate of the hydrocarbon feed stream mixed with the phosphorus compound should be such that the time required for the passage of the mixture through the reactor (residence time) will preferably be in the range of about 0.1 to about 2 hours. This generally requires a liquid hourly space velocity in the range of about 0.05 to about 10 cc of oil per cc of catalyst per hour. For a batch process, the mixture should simply remain in the reactor under reaction conditions for a time preferably in the range of about 0.1 to about 2 hours (again generally referred to as residence time).

The demetallization process of the present invention can be carried out at any suitable temperature. The temperature will generally be in the range of about 150° to about 550° C. and will preferably be in the range of about 300° to about 450° C. Higher temperatures do improve the removal of metals but temperatures should not be utilized which will have adverse effects on the hydrocarbon containing feed stream and also economic considerations must be taken into account. Lower temperatures can generally be used for lighter feeds.

A gas is also preferably mixed with the mixture of the hydrocarbon containing feed stream and the phosphorus compound. The gas allows high pressure operation to be achieved and also gases such as hydrogen, which is the most preferred gas, provide other desirable effects such as reduced coking. Also, it has been found that, for a continuous process, the flow rate of the hydrogen can have an effect on the amount of the metals removed as will be discussed more fully hereinafter. Other inert gases such as nitrogen, methane and carbon dioxide can be utilized but these gases are less desirable since they in general do not provide the desirable effects of hydrogen. Free oxygen containing gases such as air may also be utilized but, while these gases do not seem to effect the amount of metals removed, free oxygen containing gases do seem to make the hydrocarbon containing feed stream more viscous.

Any suitable pressure may be utilized in the demetallization process. When a non-oxygen containing gas is utilized, the reaction pressure will generally be in the range of about atmospheric to about 5,000 psig. Preferably, the pressure will be in the range of about 100 to about 2500 psig. Higher pressures tend to reduce coke formation but operation at high pressure may have adverse economic consequences.

As have been previously stated, higher hydrogen flow rates generally improve the removal of metals. Thus, for a continuous process, the flow rate of hydrogen is preferably above 1000 standard cubic feet per barrel of the hydrocarbon containing feed stream and more preferably above about 5000 standard cubic feet per barrel of the hydrocarbon containing feed stream.

Special solvents are not required for the addition of the phosphorus compounds to the hydrocarbon containing feed stream being treated. If the phosphorus compounds are gaseous or liquid, the phosphorus compounds can be pumped in that form into the hydrocarbon containing feed stream. If the phosphorus compounds are solid, the phosphorus compounds can be dissolved in the hydrocarbon containing feed stream or, if desired, the solid phosphorus compounds can be dissolved in any suitable solvent.

As has been previously stated, it is believed that the phosphorus compounds react with metals containing in the heavy oil to form oil insoluble substances. These oil insoluble substances can be removed from the hydrocarbon containing feed stream by any suitable method. Filtration is presently preferred but other methods such as centrafugation and decantation can be utilized if desired.

If the demetalization process of the present invention is used in a refinery where hydrodesulfurization is practiced, it is preferred to employ the demetalization process after the hydrodesulfurization step since the phosphorus compounds may interfere with hydrodesulfurization. The fact that the feedstream has been passed through a hydrodesulfurization process does not affect the demetalization process of the present invention.

The following examples are presented in further illustration of the invention.

EXAMPLE 1

Demetallization in accordance with the present invention was carried out as a batch process in a stirred autoclave reactor. The hydrocarbon containing feed stream used was either a Monogas Pipeline oil or a Gulf of Suez oil. The Monogas Pipeline oil is a heavy Venezuelan crude diluted with a few percent of fuel oil to reduce its viscosity so that it can be shipped by pipeline. This oil contains 330 parts per million vanadium and 86 parts per million nickel. The Gulf of Suez oil is an Egyptian crude having an API gravity of about 30–35. This oil contains 33 parts per million of vanadium and 22 parts per million of nickel.

The stirred autoclave reactor was charged with weighed amounts of the crude oil and of the phosphorus compound (when used) so as to provide the weight percent of the phosphorus compound set forth in Table 1. Runs 1–20 and 23–26 use Monogas Pipeline oil while runs 21 and 22 used Gulf of Suez oil. The contents of the autoclave reactor were heated to a predetermined temperature for about 1 hour and then held at that temperature for the time indicated as the reaction time. After cooling, the mixture in the autoclave was filtered through a fritted glass filter and analyzed for nickel and vanadium by atomic absorption spectrometry and plasma emission spectrometry, respectively. Table 1 summarizes the conditions for each run and the results with respect to the demetallization of the Monogas Pipeline oil or Gulf of Suez oil.

TABLE 1

| Run | Additive and Concentration in Weight Percent | | Gas | Initial Gas[1] Pres. (psig) | Temp (°F.) | Reaction Time, (hrs) | % V Removed | % Ni Removed |
|---|---|---|---|---|---|---|---|---|
| 1 | 5.2% | diphenyl phosphite | Air | 0 | 783 | 1 | >99 | 82 |
| 2 | 4.7% | diphenyl phosphite | Air | 100 | 783 | 1 | >99 | 81 |
| 3 | 4.6% | diphenyl phosphite | $H_2$ | 0 | 783 | 1 | >99 | 71 |
| 4 | 4.5% | diphenyl phosphite | $H_2$ | 100 | 783 | 1 | >99 | 82 |
| 5 | None | | Air | 0 | 783 | 1 | 68 | 65 |
| 6 | None | | Air | 100 | 783 | 1 | 73 | 71 |
| 7 | None | | $H_2$ | 0 | 783 | 1 | 73 | 71 |
| 8 | None | | $H_2$ | 100 | 783 | 1 | 58 | 64 |
| 9 | 0.5% | diphenyl phosphite | $H_2$ | 0 | 730 | 1.5 | 39 | 5 |
| 10 | 1.1% | diphenyl phosphite | $H_2$ | 0 | 730 | 1.5 | 65 | 8 |
| 11 | 2.6% | diphenyl phosphite | $H_2$ | 0 | 728 | 1.5 | 58 | 0 |
| 12 | 0.7% | diphenyl phosphite | $H_2$ | 0 | 750 | 1 | 69 | 20 |
| 13 | 1.3% | dimethyl phosphite | $H_2$ | 0 | 783 | 1 | 74 | 60 |
| 14 | 1.2% | triethyl phosphite | $H_2$ | 0 | 783 | 1 | 78 | 59 |
| 15 | 1.0% | trimethyl phosphite | Air | 0 | 750 | 1 | 84 | 12 |
| 16 | None | | Air | 0 | 755 | 1 | 15 | 10 |
| 17 | 2.0% | trimethyl phosphite | Air | 0 | 750 | 1 | 88 | 12 |
| 18 | 0.2% | trimethyl phosphite | Air | 0 | 750 | 1 | 58 | 20 |
| 19 | 0.6% | trimethyl phosphite | Air | 0 | 775 | 1 | 67 | 2 |
| 20 | None | | Air | 0 | 755 | 1 | 12 | 0 |
| 21 | None | | Air | 0 | 784 | 1 | 41 | 41 |
| 22 | 1.0% | trimethyl phosphate | Air | 0 | 784 | 1 | 99 | 58 |
| 23 | None | | Air | 0 | 750 | 1 | 17 | 15 |
| 24 | 4.1% | tri-n-butyl phosphine | Air | 0 | 750 | 1 | 46 | 27 |
| 25 | 4.2% | n-hexyl-diphenyl phosphine | Air | 0 | 750 | 1 | 53 | 18 |
| 26 | 4.1% | triphenyl phosphine | Air | 0 | 750 | 1 | 24 | 21 |

[1]pressure in autoclave before heating.

Referring to Table 1, runs 1–4 illustrate that, at the concentration of the diphenylphosphite used, demetallization is essentially independent of the kind of gas or its pressure in the reaction vessel. A comparison of runs 1–4 with 5–8 illustrate that the use of the phosphorus compound results in a substantially improved removal of vanadium and a generally improved removal of nickel. The remaining runs of Table 1 illustrate the effect of various phosphorus compounds at different temperatures and concentrations. Comparative runs show that the use of the phosphorus compounds results in a substantially improved removal of vanadium but the removal of nickel does not always improve at the temperatures and concentrations used. Thus, it can be seen that the use of the phosphorus compounds results in a substantial improvement in the removal of vanadium and under certain conditions results in an improvement in the removal of nickel. It can also be seen from Table 1 that temperature has a substantial effect on the demetallization process which will be discussed more fully hereinafter in an example directed specifically to the effect of temperature.

Runs 23–26 were used primarily to examine whether phosphine would be effective. It is difficult to test phosphine in a laboratory because of its poisonous nature and the adverse smell. However, since phosphine is a gas it could be readily mixed with a feedstock and a refinery could handle phosphine. The results of runs 23–26 indicates that phosphine would be effective since the heavier organic phosphine compounds were effective.

EXAMPLE 2

A reactor packed with 124 mL of alundum (an $\alpha$-$Al_2O_3$ having a surface area of less than 10 $m^2/g$) was utilized to demonstrate a continuous demetallization process in accordance with the present invention. The alundum was used to permit operation in a trickle bed mode and is not considered to be a catalyst for demetallization.

The hydrocarbon feed stream consisted of 75 weight percent Monogas Pipeline and 25 weight percent xylene. The hydrocarbon containing feed stream contained 250 ppm vanadium and 60 ppm nickel. Diphenylphosphite (when used) was mixed with the hydrocarbon feed stream and the resulting mixture was passed down flow through their reactor. Hydrogen was also added to the mixture flowing through the reactor at the rate of 30 liters per hour. The operating pressure was 1000 psig while the operating temperature was 440° C. The liquid reaction product was filtered through a fritted glass filter and analyzed. Other conditions of the test as well as the results of the analysis are set forth in Table 2.

TABLE 2

| RUN | WEIGHT PERCENT ADDITIVE | FEED RATE (mL/hr) | RESIDENCE TIME (HRS) | V REMOVED (%) |
|---|---|---|---|---|
| 1 | 0 | 43 | .9 | 31.6 |
| 2 | 3.6 | 43 | .9 | 97.7 |
| 3 | 1.0 | 43 | .9 | 94.0 |
| 4 | 0.5 | 47 | .8 | 86.5 |
| 5 | 0.5 | 34 | 1.2 | 90.1 |
| 6 | 0.25 | 55 | .7 | 76.0 |

An examination of Table 2 illustrates that the diphenylphosphite was effective for removing vanadium and that the removal of vanadium was generally proportional to the concentration of the diphenylphosphite. Also, a comparison of runs 3 and 4 indicate that a longer residence time improved the removal of vanadium. The amount of nickel removed was not measured.

EXAMPLE 3

Using the packed reactor of Example 2, the effect of temperature on the removal of vanadium was investigated. The results of this investigation are set forth in FIG. 1. The hydrocarbon containing feed stream was 74 weight percent Monogas Pipeline oil and 26 weight percent toluene. Hydrogen was added to the feed mixture at 30 liters per hour and the operating pressure was 1000 psig. Diphenylphosphite (when used) was mixed with the feed hydrocarbon at a rate sufficient to provide the weight percent of diphenylphosphite set forth in FIG. 1. The residence time was 40 minutes in all runs. The liquid reaction product was again filtered through a fritted glass filter and analyzed for vanadium as in Example 2.

Referring to FIG. 1, it can be seen that, for the temperature range shown, temperature does not have a significant effect for high concentrations of the phosphorus compound. However, at lower concentrations temperature does have a substantial effect with higher removals of vanadium being achieved at higher temperatures.

EXAMPLE 4

The effect of reaction time on the removal of vanadium was investigated using the procedure of Example 3 with the exception that the temperature was held constant at 425° C. while the reaction time was varied. Also, in addition to diphenylphosphite, trimethylphosphate was tested. The concentration of the diphenylphosphite and trimethylphosphate was 0.5 weight percent based on the weight of the hydrocarbon feed stream. Results of the test are illustrated in FIG. 2.

Figure 2:
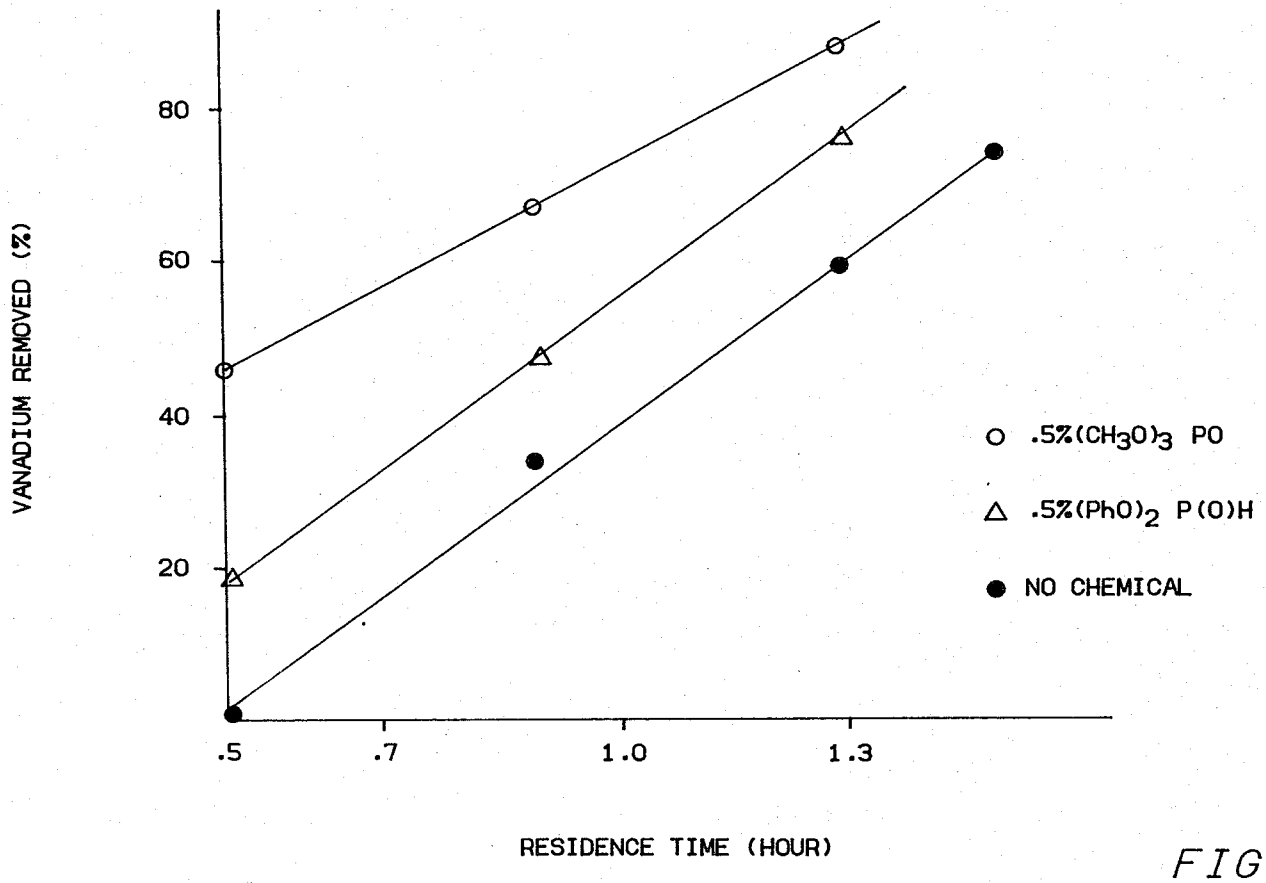

Referring to FIG. 2, it can be seen that in all cases an increased residence time improved the removal of vanadium.

EXAMPLE 5

The effect of diphenylphosphite concentration on the removal of vanadium using the packed reactor of Example 2. The hydrocarbon feed stream was again 74 percent Monogas Pipeline oil and 26 weight percent toluene. The reactor was maintained at a temperature of 440° C. and the residence time was 0.5 hours. Hydrogen flow was again 30 liters per hour and the operating pressure was 1000 psig. The results of the test are illustrated in FIG. 3.

Figure 3:
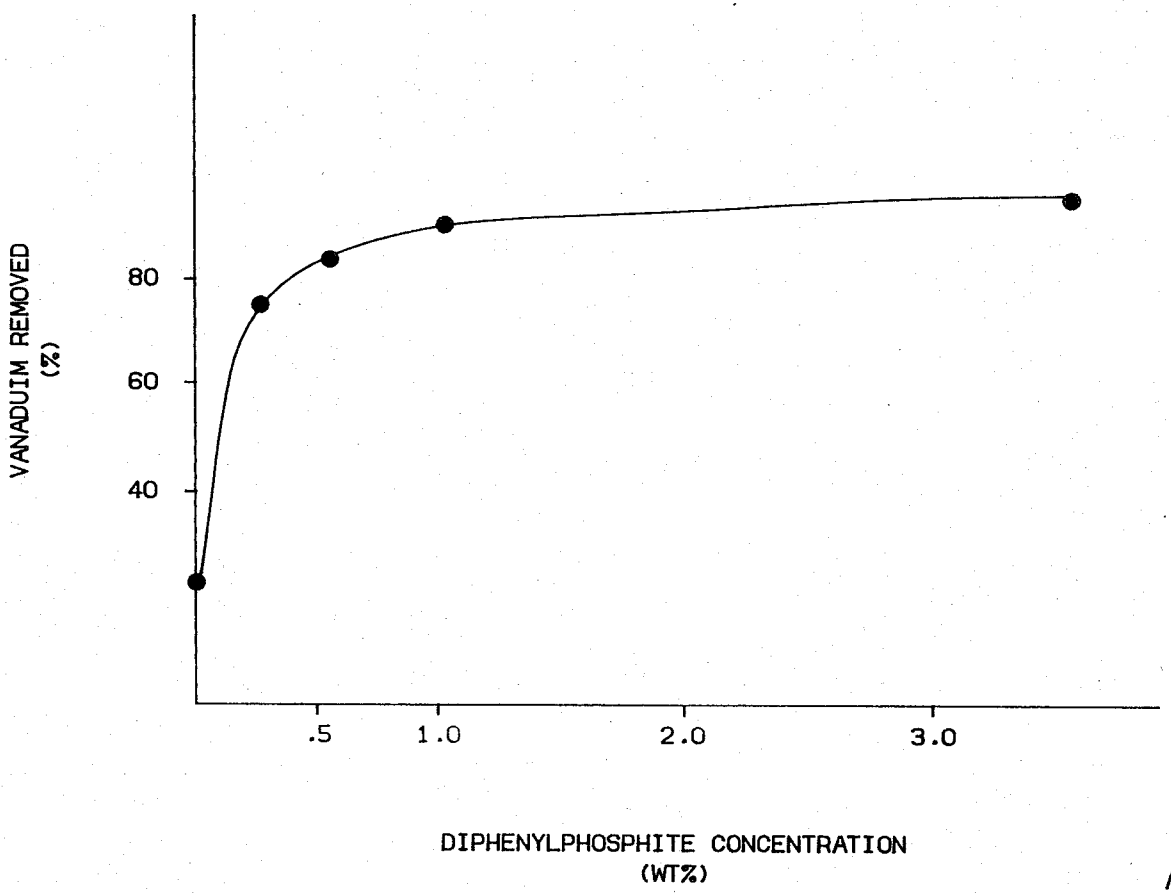

Referring to FIG. 3, it can be seen that, above a concentration of about 1.0 weight percent, the concentration of the diphenylphosphite has little effect. However, below a concentration of about 1.0 weight percent the effectiveness of the diphenylphosphite begins to fall off slowly and then rapidly as the concentration of diphenylphosphite goes below about 0.2 weight percent.

EXAMPLE 6

The effects of the hydrogen flow rate on the removal of vanadium was tested using the packed reactor of Example 2. The hydrocarbon containing feed stream was 74 weight percent Monogas Pipeline oil and 26 weight pecent toluene. 0.7 weight percent of trimethylphosphate, based on the weight of the hydrocarbon containing feed stream was added to the hydrocarbon containing feed stream. The operating pressure was 1000 psig and the temperature was maintained at 425° C. The residence time was about 1.4 hours. The results of the test are set forth in FIG. 4.

Figure 4:
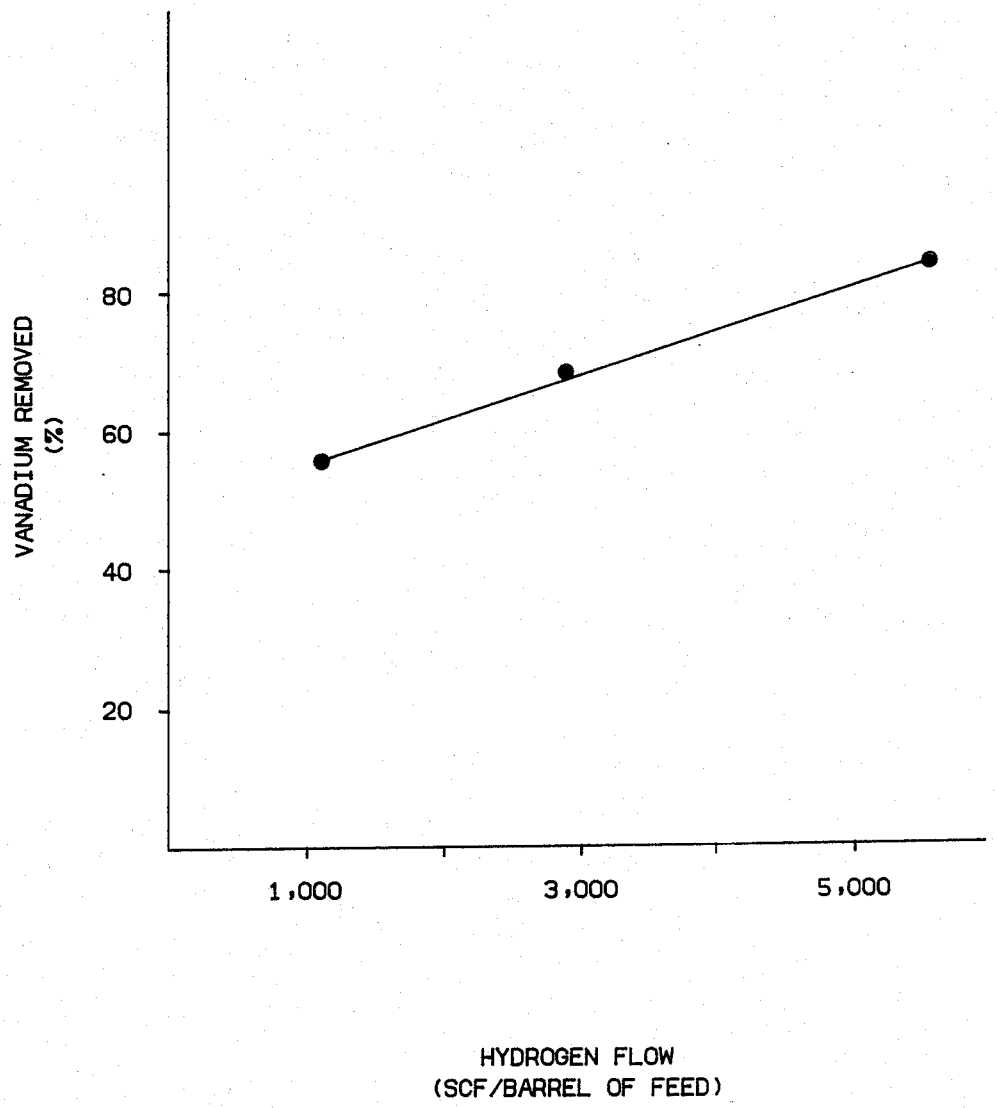

Referring to FIG. 4, it can be seen that the removal of vanadium was improved at higher hydrogen flow rates. This was a surprising result in view of the fact that the hydrogen consumption remained substantially the same in all cases.

EXAMPLE 7

Demetallization in accordance with the present invention was carried out as a batch process in a stirred autoclave reactor. The hydrocarbon containing feed stream used was a heavy oil extract prepared by extraction of Monogas Pipeline oil with normal pentane under super critical conditions with subsequent stripping of the normal pentane. Since the supercritical extract removes a major portion of the dissolved metal (vanadium, nickel) compounds from the Monogas Pipeline oil, heating at temperatures lower than those temperatures used in the runs of Example 1 was sufficient for demetallization of the heavy oil extract. The heavy oil extract contained 126 parts per million of vanadium and 22 parts per million of nickel.

The stirred autoclave reactor was charged with weighed amounts of the heavy oil extract and of the phosphorus compound (when used) so as to provide the weight percent of the phosphorus compound set forth in Table 3. The contents of the autoclave reactor were heated to a predetermined temperature for about 1 hour and then held at that temperature for the time indicated as the reaction time. After cooling, the mixture in the autoclave was filtered through a fritted glass filter and analyzed for nickel and vanadium. Table 3 summarizes the conditions for each run and the results with respect to the demetallization of the heavy oil extract.

TABLE 3

| Run | Additive and Concentration in Weight Percent | Gas | Initial Gas[1] Pres. (psig) | Temp (°F.) | Reaction Time, (min) | % V Removed | % Ni Removed |
|---|---|---|---|---|---|---|---|
| 1 | 10.0% trimethyl phosphate | Air | 0 | 678 | 60 | 83 | 0 |
| 2 | 2.0% trimethyl phosphate | Air | 0 | 678 | 60 | 50 | 2 |
| 3 | 2.0% trimethyl phosphate | Air | 0 | 678 | 20 | 32 | 0 |
| 4 | 11.1% trimethyl phosphate | Air | 0 | 603 | 60 | 54 | 0 |
| 5 | 11.1% trimethyl phosphate | Air | 0 | 603 | 20 | 45 | 0 |
| 6 | 2.0% trimethyl phosphate | Air | 0 | 603 | 20 | 21 | 0 |
| 7 | 10.0% trimethyl phosphite | Air | 0 | 605 | 60 | 82 | 0 |
| 8 | 10.3% trimethyl phosphite | Air | 0 | 596 | 20 | 79 | 0 |
| 9 | 2.1% trimethyl phosphite | Air | 0 | 605 | 20 | 61 | 0 |
| 10 | 2.2% trimethyl phosphite | Air | 0 | 593 | 20 | 56 | 0 |

[1]pressure in autoclave before heating

Referring to Table 3, the data indicates that a substantial removal of the most undesirable metal (vanadium) from heavy oil extract is accomplished at lower temperatures than required for the heavy oils of Example 1. No control run was utilized in this example since it was felt that all of the metals which could be removed by simple heat treatment had been removed in preparing the extract. While nickel removal was measured, the nickel removal measurement is not thought to be reliable because it is thought that nickel was lost from the wall of the reactor and removed in the extract in these particular runs.

Reasonable variations and modifications are possible within the scope of the disclosure and the appended claims.

That which is claimed:

1. A process for removing metals contained in a hydrocarbon containing feed stream comprising the steps of:

contacting said hydrocarbon containing feed stream under suitable demetallization conditions with a phosphorus compound selected from the group consisting of phosphine, hydrocarbylphosphines, hydrocarbylphosphites, hydrocarbylphosphonates, hydrocarbylphosphates, hydrocarbylphosphine oxides, hydrocarbylthiophosphites, and hydrocarbylphosphine sulfides to convert said metals to oil insoluble compounds; and removing said oil insoluble compounds of said metals from said hydrocarbon containing feed stream in the absence of a cracking catalyst.

2. A process in accordance with claim 1 wherein said hydrocarbon containing feed stream is selected from the group consisting of crude oil, topped crude, residuum and heavy oil extracts.

3. A process in accordance with claim 1 wherein said metals are selected from the group consisting of vanadium and nickel.

4. A process in accordance with claim 1 wherein the amount of said phosphorus compound contacted with said hydrocarbon containing feed stream is in the range of about 0.01 to about 50 weight percent based on the weight of said hydrocarbon containing feed stream.

5. A process in accordance with claim 1 wherein the amount of said phosphorus compound contacted with said hydrocarbon containing feed stream is in the range of about 0.05 to about 5 weight percent based on the weight of said hydrocarbon containing feed stream.

6. A process in accordance with claim 1 additionally comprising the step of contacting said hydrocarbon containing feed stream with a gas.

7. A process in accordance with claim 6 wherein said gas is hydrogen.

8. A process in accordance with claim 7 wherein said organic compound, said hydrocarbon containing feed stream and said hydrogen are contacted in a reactor and wherein said suitable demetallization conditions comprise a reaction time for the mixture of said hydrocarbon containing feed stream, said organic phosphorus compound and said hydrogen in said reactor in the range of about 0.01 hours to about 100 hours, a temperature in the range of about 150° C. to about 550° C., a pressure in the range of from about atmospheric to about 5000 psig and wherein hydrogen is added to said hydrocarbon containing feed stream at a rate of at least about 1000 standard cubic feet per barrel of the hydrocarbon containing feed stream.

9. A process in accordance with claim 7 wherein said phosphorus compound, said hydrocarbon containing feed stream and said hydrogen are contacted in a reactor and wherein said suitable demetallization conditions comprise a reaction time for the mixture of said hydrocarbon containing feed stream, said organic phosphorus compound and said hydrogen in said reactor in the range of about 0.1 hours to about 2 hours, a temperature in the range of about 300° C. to about 450° C., a pressure in the range of from about 100 psig to about 2500 psig and wherein hydrogen is added to said hydrocarbon containing feed stream at a rate of at least about 5000 standard cubic feet per barrel of the hydrocarbon containing feed stream.

10. A process in accordance with claim 1 wherein said step of removing said oil insoluble compounds of said metals from said hydrocarbon containing feed stream comprises filtering said hydrocarbon containing feed stream.

* * * * *